US005201637A

United States Patent [19]

Folland et al.

[11] Patent Number: 5,201,637

[45] Date of Patent: Apr. 13, 1993

[54] HYDRAULIC PISTON PUMP WITH SERVO DISPLACEMENT CONTROL

[75] Inventors: Kevin V. Folland; Xudong Yu, both of Omaha, Nebr.

[73] Assignee: Vickers, Incorporated, Troy, Mich.

[21] Appl. No.: 783,520

[22] Filed: Oct. 28, 1991

[51] Int. Cl.[5] ..... F04B 1/26

[52] U.S. Cl. ..... 417/218; 92/122

[58] Field of Search ..... 92/12.1, 12.2, 13.1, 92/120, 121, 122, 123, 124, 125; 91/506, 375; 417/218

[56] References Cited

U.S. PATENT DOCUMENTS 3,332,323 7/1967 Roeske ..... 92/13.1 X 3,967,541 7/1976 Born et al. ..... 92/121 X 4,739,693 4/1988 Honaga et al. ..... 91/375 A

*Primary Examiner*—Leonard E. Smith

*Attorney, Agent, or Firm*—Barnes, Kisselle, Raisch, Choate, Whittemore & Hulbert

[57] ABSTRACT

A variable displacement hydraulic piston pump and servo displacement control which combines a rotary vane type actuator and a port plate to obtain both servo and actuation functions for a hydraulic piston pump. The control includes a construction which provides feel to the operator for how much work is being performed. The control also incorporates a failsafe mechanism so that the control is capable of transmitting torque to manually stroke the pump if charge pressure is lost.

43 Claims, 9 Drawing Sheets

HYDRAULIC PISTON PUMP WITH SERVO DISPLACEMENT CONTROL

This invention relates to a hydraulic piston pump with a servo displacement control.

BACKGROUND AND SUMMARY OF THE INVENTION

Hydrostatic power transmissions are commonly used for many purposes such as, for example, vehicular drives. These transmissions utilize a variable displacement hydraulic pump connected by fluid conduits to a hydraulic motor to vary the speed of the motor. Medium duty transmissions may require power assist to stroke the transmission. Such power assists may be in the form of a hydraulic piston such as shown in U.S. Pat. No. 3,650,107. One problem with such power assists is that one or more pistons of the power assist engage a yoke to vary the displacement of the pump. However, the forces on the yoke at these points of displacement are usually too high to permit manual stroking of the pump, if necessary. Another shortcoming of the current power assists being used is the lack of "feel", that is, a machine operator receives no sense of the work effect through the control linkage.

Among the objectives of the present invention are to provide a hydraulic pump with servo displacement control which obviates the aforementioned problems by providing manual stroke, if necessary, and which provides a sense of feel. The control combines servo and actuation functions. In other words, servo functions are obtained as long as hydraulic control pressure is maintained; however, if that hydraulic control pressure is ever lost, manual actuation of the yoke to stroke the pump is obtained through the control. A rotary vane actuator provides yoke turning torque and is combined with a port plate to provide the servo function. The combination of the servo and actuation functions reduces package size, part count, cost, utilizes a minimum number of parts, allows manufacturing at low cost and provides an assembly that can be readily mounted on a pump.

In order to provide the operator with feel, a torsion bar is incorporated into the control and is anchored to one end of the yoke pintle so that a portion of the yoke forces will be transmitted through the torsion bar to the operator.

Another advantage of the integral type servo control is the reduction and simplification of control linkages. The integral servo control eliminates yoke vibrations transmitted to the control linkage that occurs during the damping action of the stroking pistons. Yoke vibrations which are transmitted to the control linkage are a major source of noise. Therefore, the servo control not only eliminates yoke vibrations but also reduces noise.

In accordance with the invention, the servo displacement control is a stand alone sub-assembly designed to be readily bolted onto an existing device. The servo control combines actuation and servo functions and incorporates a torsion bar to provide an operator with feel for the amount of work being performed. The servo control also has a fail safe feature which allows manual stroking of the yoke in the event that the control pressure is lost.

DESCRIPTION OF THE DRAWINGS

FIG. 9 is a sectional view taken along line 9—9 in

DESCRIPTION

Figure 1:
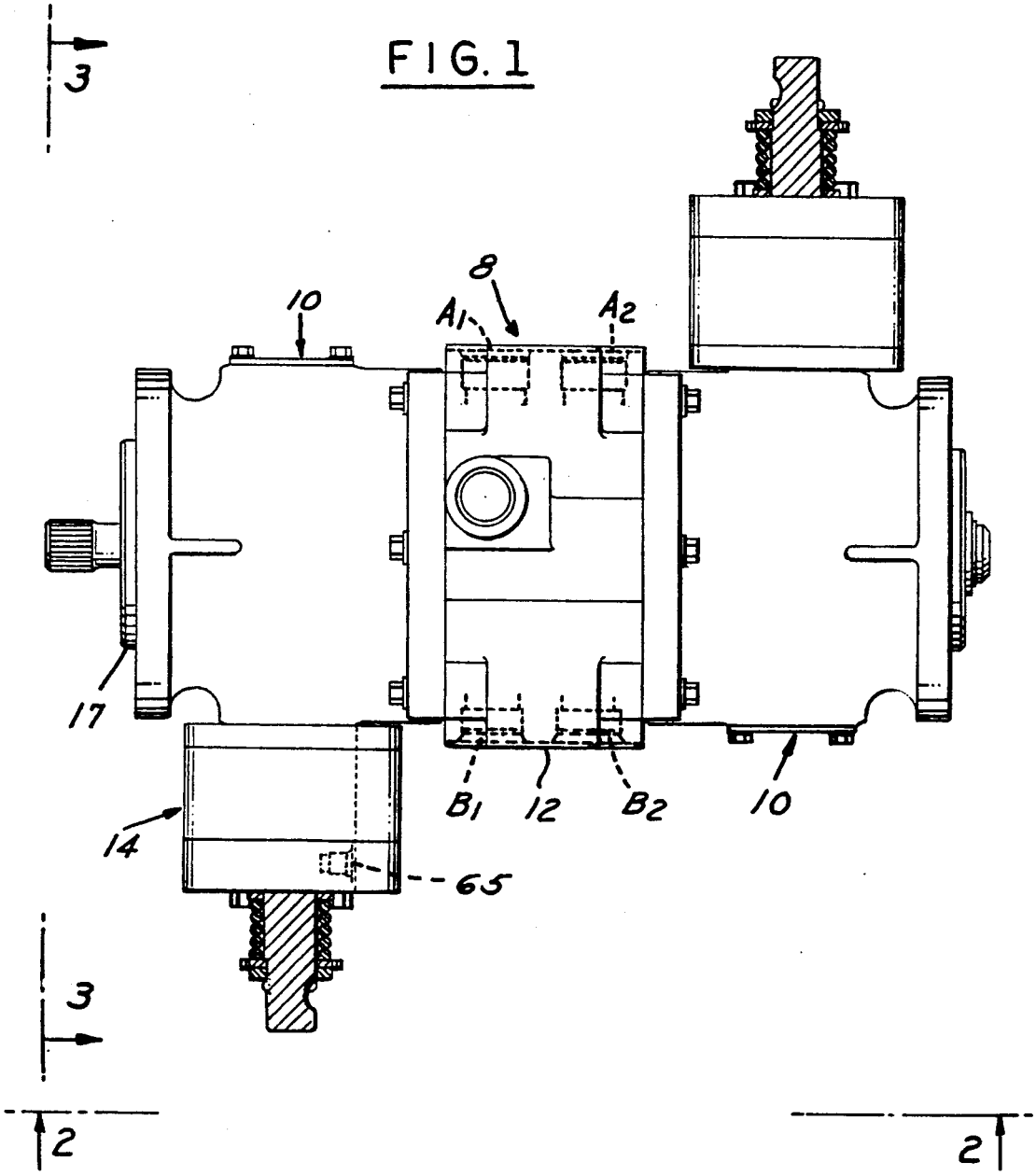
FIG. 1 is a top view of the integral servo control and hydraulic pump housing incorporated in a preferred form of the present invention.
Figure 2:
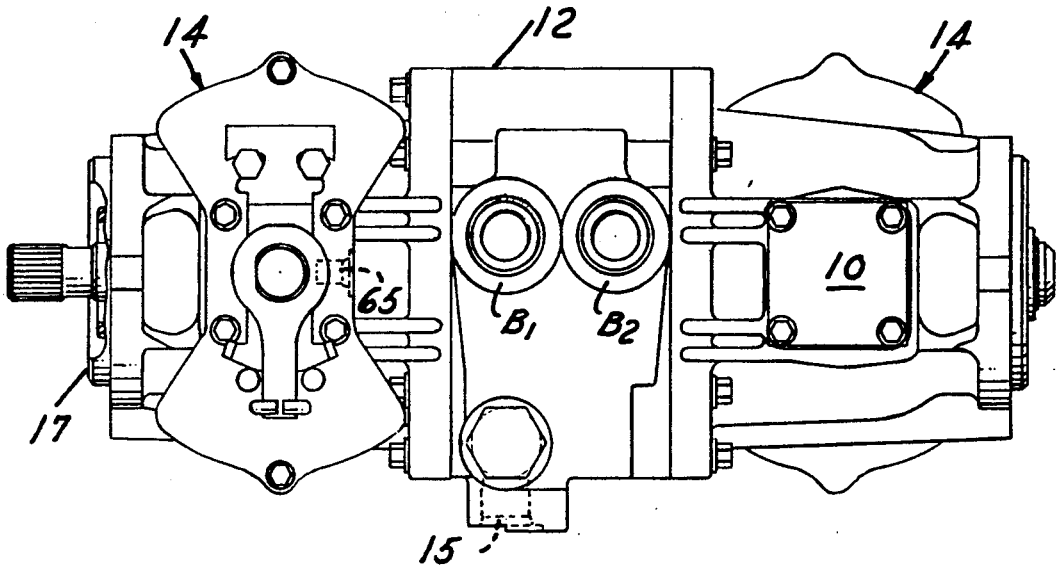
FIG. 2 is a front view of the assembly shown in FIG. 1.
Figure 3:
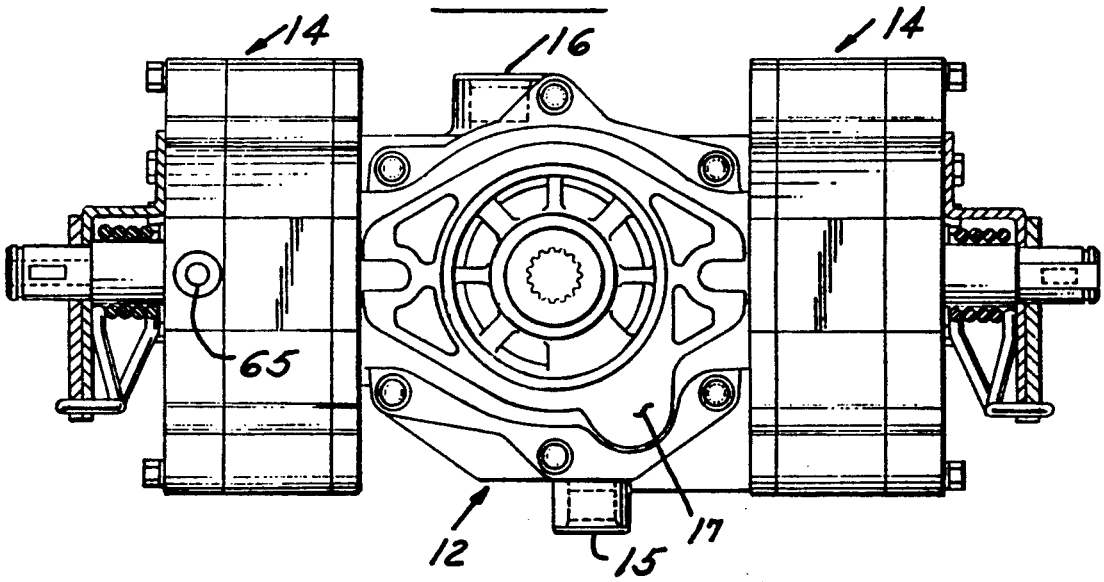
FIG. 3 is an end view of the assembly shown in FIG. 1.

Referring to FIGS. 1–3, the invention relates particularly to a pressure energy translating device in the form of a pump or motor 10, two which are shown mounted to a common valving block 12. The servo control is a stand alone sub-assembly 14 designed to be mounted to the existing pumps or motors 10. The valving block 12 contains four sets of outlet/inlet ports $A_1$, $A_2$, $B_1$ and $B_2$, two sets for each pump/motor. The valving block also contains a drain port 16 and an external supercharge port 15 as seen in FIG. 3.

Figure 4:
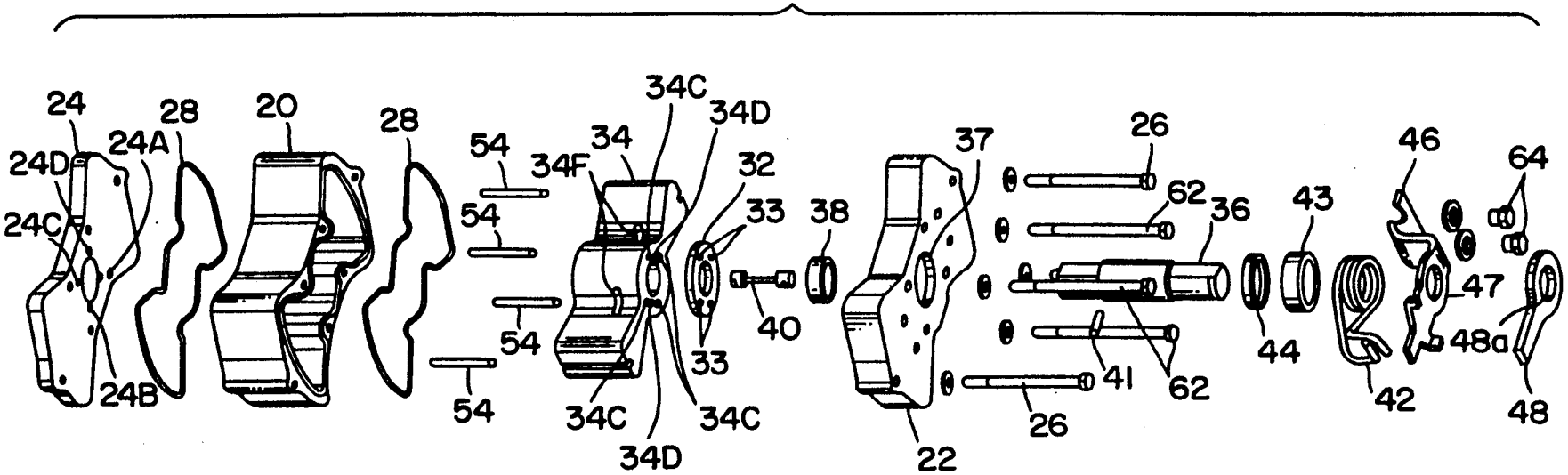
FIG. 4 is an exploded view of the rotary vane actuator.
Figure 5:
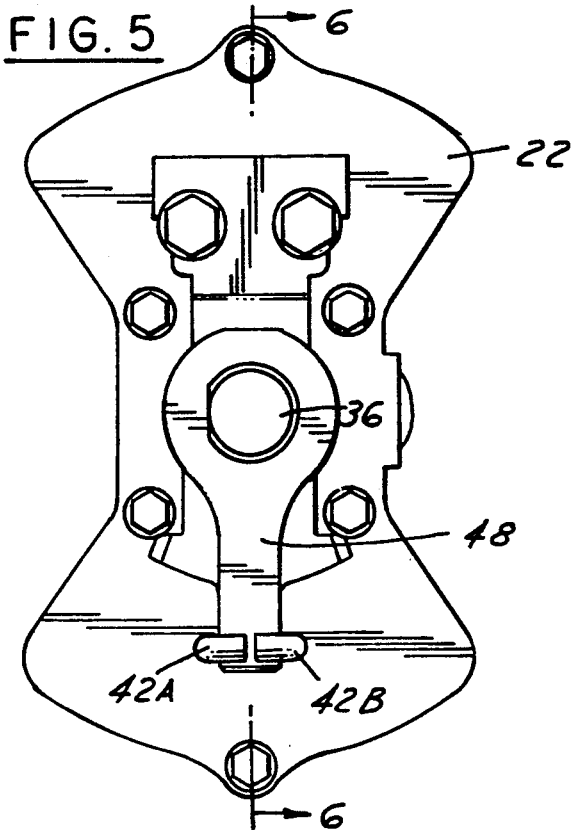
FIG. 5 is an end view of the power assist control.
Figure 6:
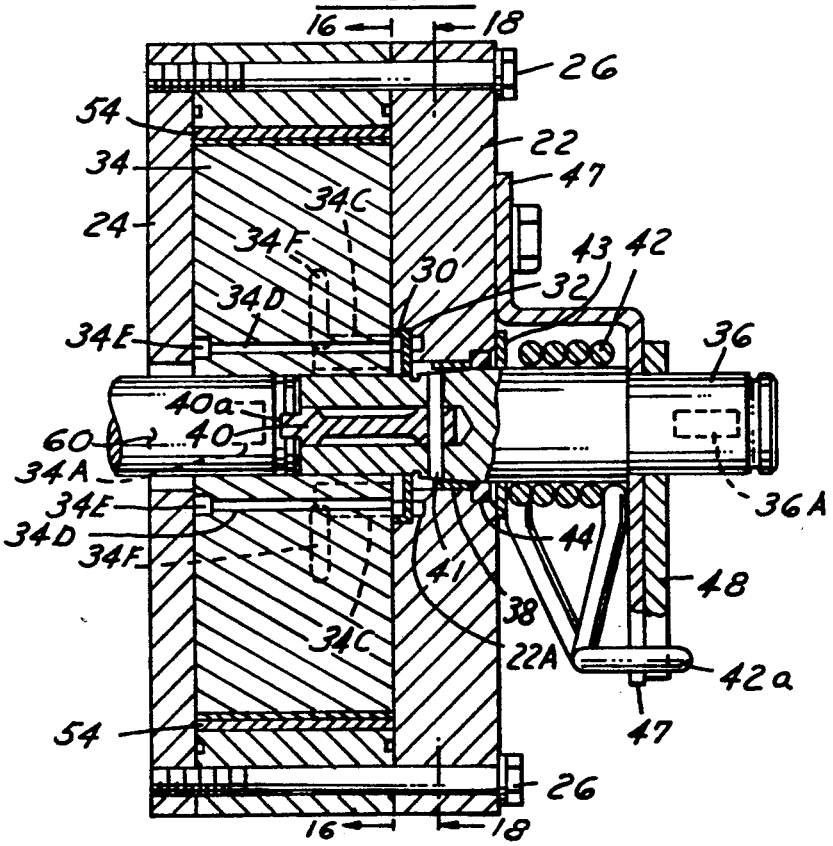
FIG. 6 is a sectional view taken along line 6—6 in FIG. 5.
Figure 9:
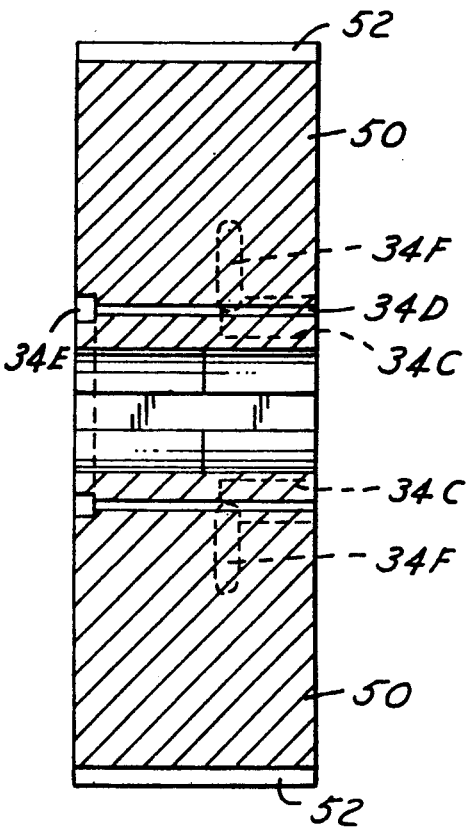
Figure 7:
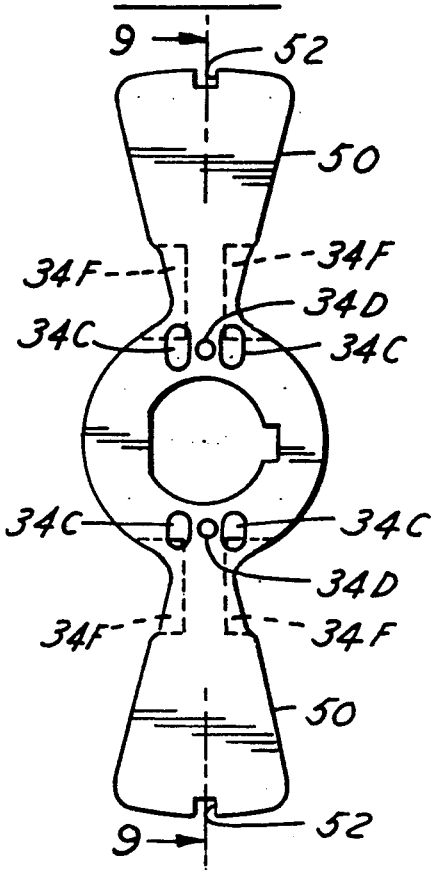
FIG. 7 is an end view of the power assist vane actuator.
Figure 10:
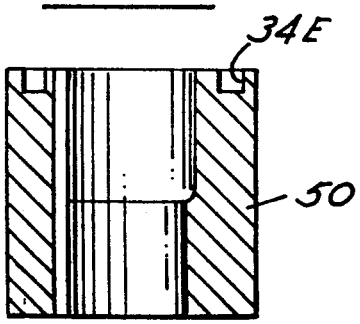
FIG. 10 is a sectional view taken along line 10—10
Figure 8:
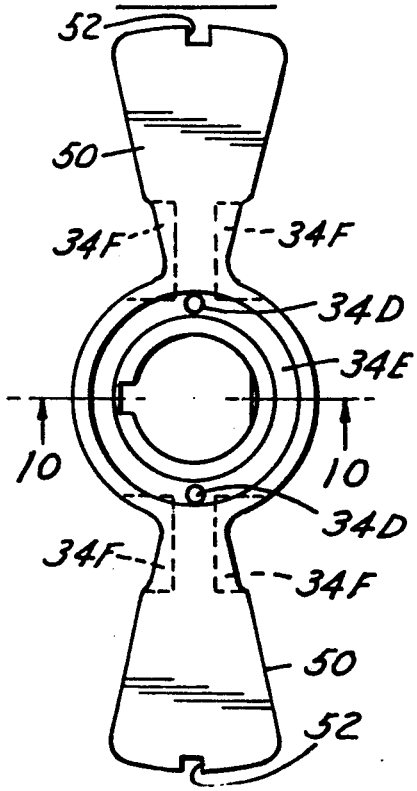
FIG. 8 is a view of the opposite end of the vane actuator seen in FIG. 7.
Figure 11:
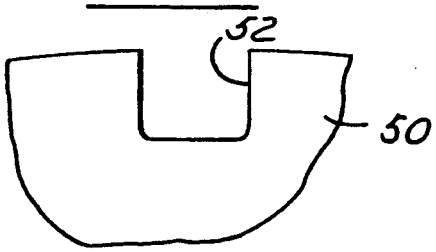
FIG. 11 is a fragmentary view of a portion of the rotary vane.
Figure 12:
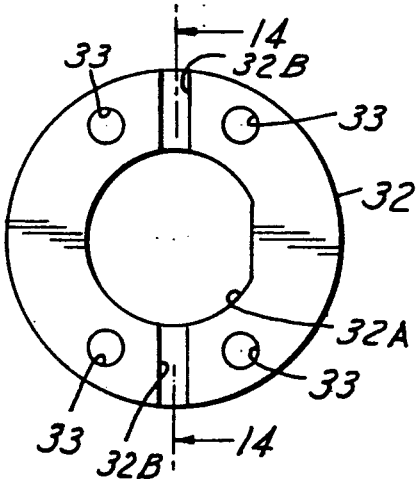
FIG. 12 is a front view of the port plate.
Figure 13:
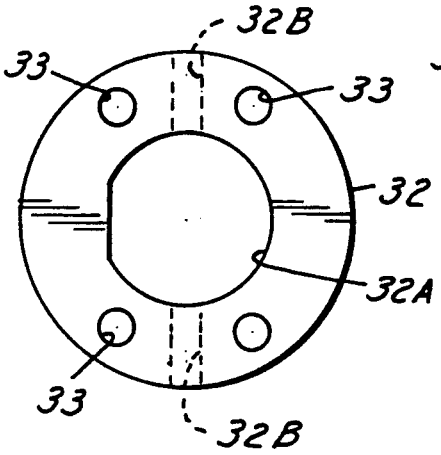
FIG. 13 is a rear view of the port plate.
Figure 14:
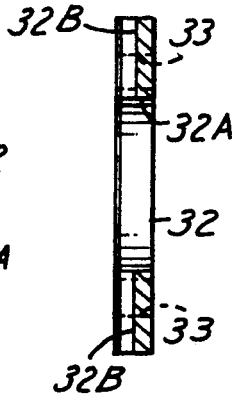
FIG. 14 is a sectional view of the port plate taken along line 14—14 in FIG. 12.

Referring to FIGS. 4–6, a preferred form of the servo control comprises a housing 20, front and back covers 22, 24, respectively, bolted to the housing 20 by two bolts 26. O-ring seals 28 are located between the front and back covers 22, 24 and the housing 20. A rotary vane actuator 34 is located within the pocket formed by the housing 20 and front and back covers 22,24 (FIG. 6). The actuator 34 is constrained by the housing 20 to a limited rotary movement, for example, of +19.5°. Four chambers A, B, C, and D (FIG. 16) are formed by the actuator 34 and the housing 20. These chambers are located on either side of the actuator vane tips. These chambers are hydraulically isolated from each other by four linear seals 54. Two linear seals 54 are located at the vane tips inside groove 52. The remaining two linear seals 54 are located in grooves 20A located on the center bore of housing 20. The actuator 34 is directly coupled to the yoke pintle 60 of the pump/motor by a Woodruff key way 34A. The yoke pintle 60 (FIG. 6)

extends into actuator 34 to approximately one half the actuator thickness. The input shaft 36 is inserted into the "D" hole 34B in the top of actuator 34 (FIG. 16) and is a loose fit. The input shaft extends through opening 37 of the front cover 22. The opening 37 also contains a shaft bearing 38 and a shaft seal 44. The shaft seal 44 is retained by spacer 43. The input shaft 36 contains a torsion bar 40 which has one end retained by pin 41 inside of shaft 36. The other end of torsion bar 40 is coupled to the yoke pintle 60 via tang 40*a* and a mating slot in the end of the yoke pintle 60. The torsion bar provides resistance to the input shaft 36. The resistance created by the torsion bar provides the control with feel for the amount of work being performed.

A port plate 32 is constrained by the counterbore 30 of front cover 22 and against the vane actuator 34. The port plate 32 is turned by input shaft 36, which passes through the center "D" slot 32A of port plate 32 with a tight fit.

Figure 15:
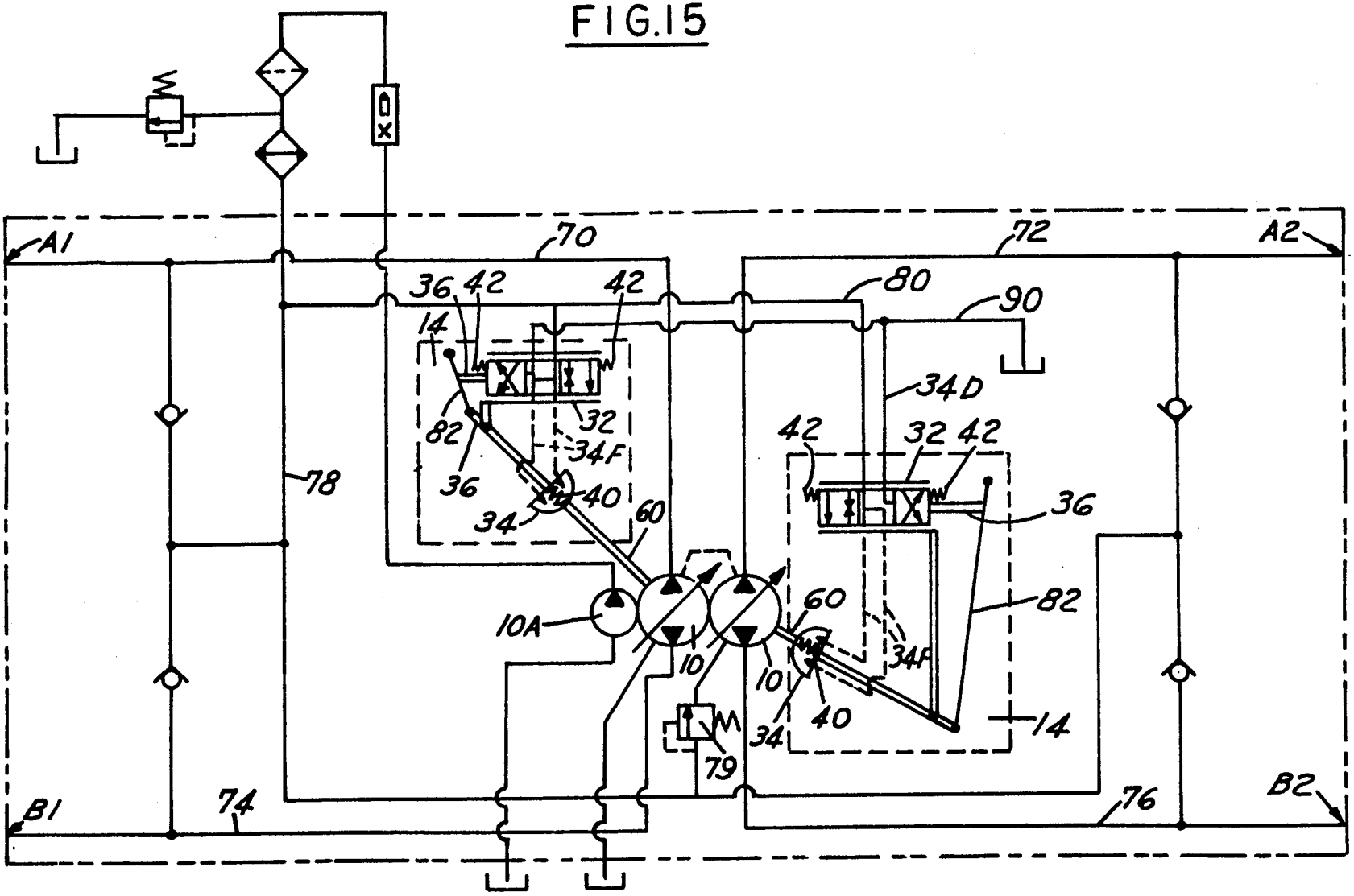
FIG. 15 is a hydraulic circuit diagram of a pump and control system incorporating a preferred form of the present invention.

Torsional spring 42 is placed over input shaft 36 and is retained between washer 43 and bracket 47. The torsional spring 42 has one leg 42*a* placed over one side of bracket 47 and support 48 and the opposite leg 42*b* is stretched and placed against the opposite side of bracket 47 and support 48 (FIG. 5). The purpose of the torsional spring 42 is to return the pump/motor to the neutral position when the attached control linkage, shown schematically at 82 in FIG. 15, is at rest. Bracket 47 is bolted onto the front cover 22 by two screws 64 and includes a flange with an opening through which the input shaft extends. The screw holes in bracket 47 are slotted to allow the setting of the pump/motor to neutral. The input shaft extends through support 48. Support 48 is turned by the shaft by means of "D" slot 48A (FIG. 4). The support 48 is retained by the bracket 47, the legs of the torsional spring 42*a* and 42*b*, and the input shaft 36. The control linkage is attached to the input shaft 36 via a Woodruff key way 36A.

The servo control subassembly is bolted to the pump or motor with four screws 62. The four screws 62 also insure that the subassembly is hydraulically sealed.

CONTROL OPERATION

The control linkage 82 is connected to the end of input shaft 36 via the Woodruff key way 36A. Turning the input shaft turns port plate 32, twists the torsion bar 40, and turns support 48. Turning support 48 displaces one leg (either 42A or 42B) of torsional spring 42. The torque provided by displacing torsional spring 42 shall return the control to neutral should the operator physically let go of the input linkage. This feature is required to insure that the vehicle shall not be started while the transmission is on stroke.

Figure 16:
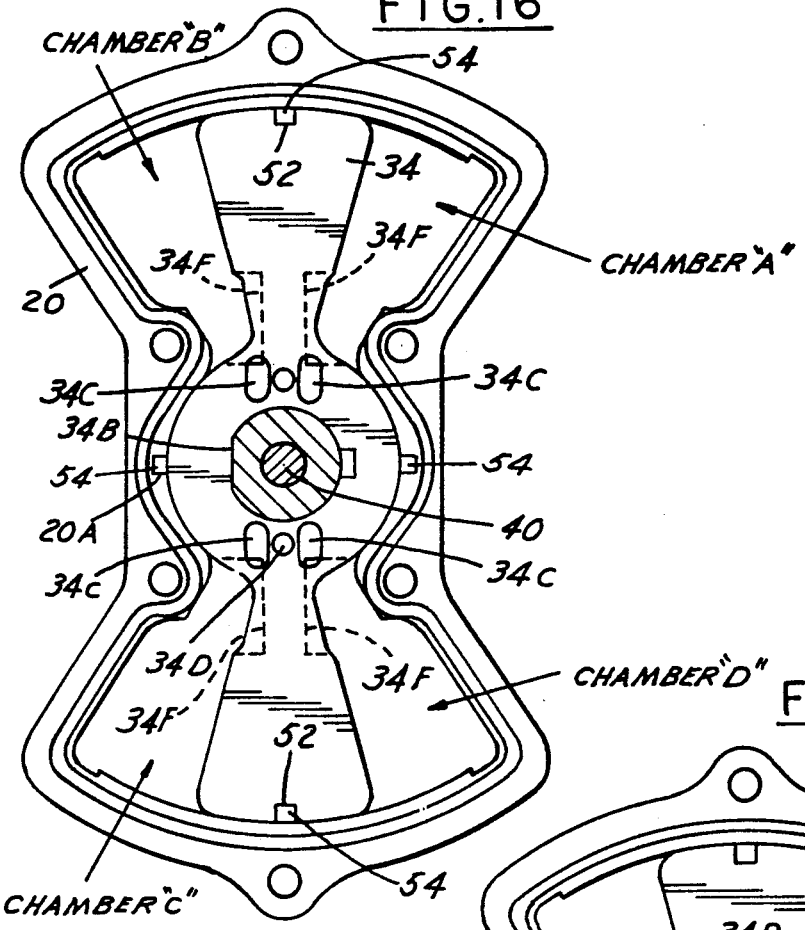
FIG. 16 is a sectional view taken along line 16—16 in FIG. 6, ports being removed.
Figure 17:
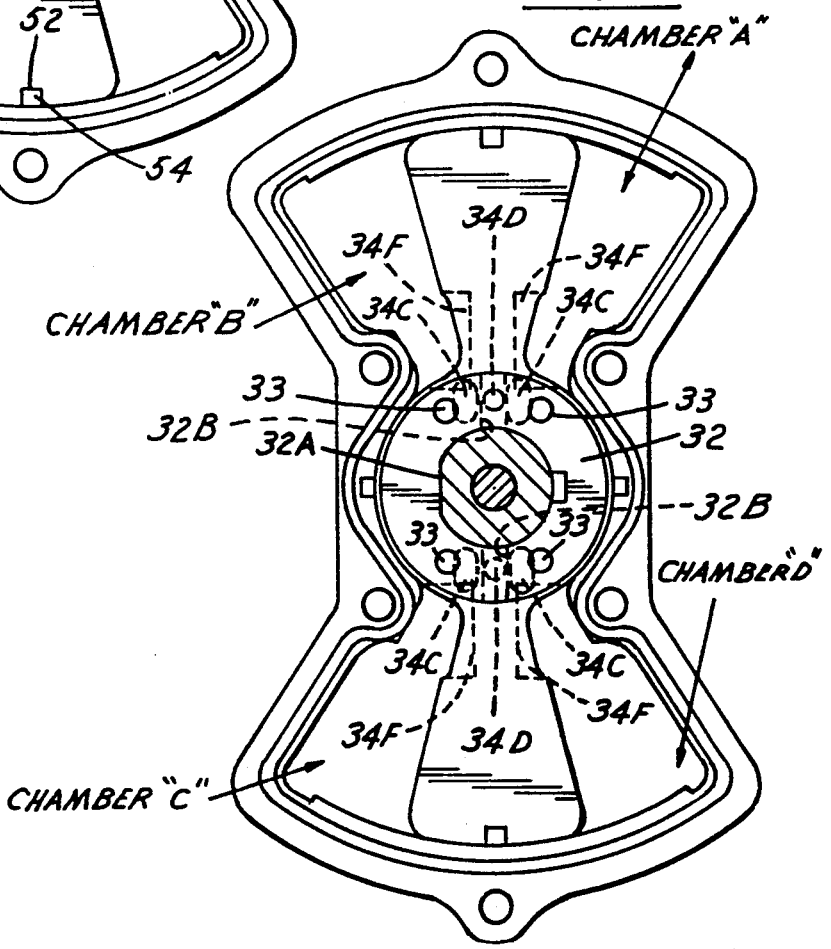
FIG. 17 is a view similar to FIG. 16 with the port plate in position.
Figure 18:
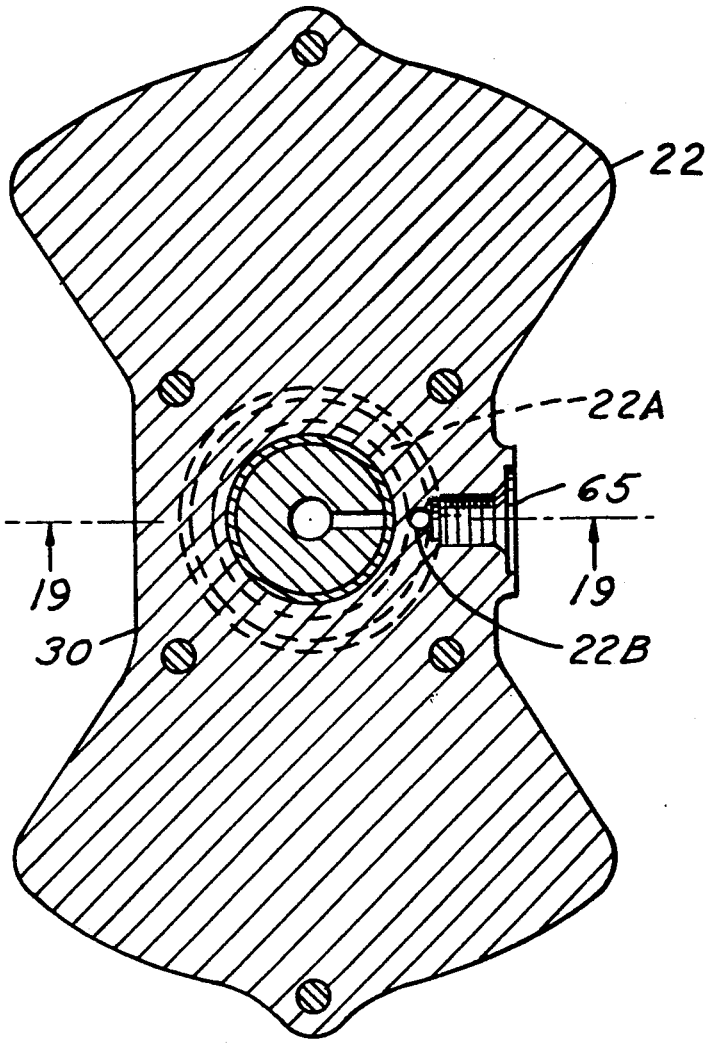
FIG. 18 is a sectional view taken along line 18—18 in FIG. 6.
Figure 19:
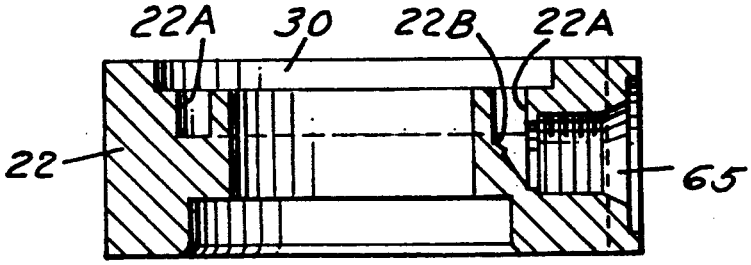
FIG. 19 is a sectional view taken along line 19—19 in FIG. 18.

Port plate 32 is supplied with supercharge hydraulic fluid pressure from pump 10A (FIG. 15.) via inlet ports 65 and 22B and annular groove 22A in cover 22 as seen in FIGS. 18 and 19. The port plate 32 in the null condition supplies supercharge pressure to chambers A, B, C and D via diametrically opposed axial supply ports 33 in the port plate and opposed axial passages 34C and radial passages 34F in the vane actuator as seen in FIGS. 16 and 17. Pressurizing all chambers in the null position provides greater stability than that given when all chambers are at drain pressure. Turning input shaft 36 turns port plate 32 which connects either chambers A and C or B and D to drain via passages 34F and 34C in the vane actuator, radial drain grooves 32B in the port plate and axial drain ports 34D in the vane actuator. Drain ports 34D in the vane actuator 34 extend through the vane actuator 34 as seen in FIG. 6. An annular groove 34E is provided in the vane actuator 34 adjacent back cover 24. The annular groove 34E communicates with the pump case and thus to tank via drain port 16 through four holes 24A-D in back cover 24 (FIG. 4). Connecting chambers A and C to tank while maintaining supercharge pressure on chambers B and D creates a torque on vane actuator 34. The turning torque on vane actuator 34 is transmitted to the yoke pintle 60 via the Woodruff key arrangement. The torque rotates the vane actuator 34 in the same direction as the input shaft 36 and port plate 32. The vane actuator continues to rotate until the holes 34C in the vane actuator become disconnected from the drain grooves 32B in the port plate and become reconnected to the supercharge supply ports 33 of the port plate. Resupplying chambers A and C to supercharge pressure returns the control to the null position.

FIG. 15 is a hydraulic circuit diagram of the present invention showing outlet/inlet ports A1, A2, B1, B2 connected to pumps 10 through lines 70, 72, 74, 76. The pump 10A supplies supercharge pressure to the the pumps 10 through line 78 to the servo controls 14 through line 80 via valves 32, representing the servo action performed between the contacting surface of the port plate 32 and the vane actuator 34. The valves 32 supply fluid through the radial passages represented by pilot lines 34F to the vane actuator 34 thus controlling pump displacement through yoke pintle 60. The vane actuator 34 and valves 32 are connected to tank by the drain ports represented by lines 34D and 90. The control linkage 82 through shaft 36 provides a direct mechanical link between the input 36 and yoke pintle 60. Input shaft 36 is capable of turning yoke pintle 60 via vane actuator 34. This is possible due to the loose "D" slot connection 34B between shaft 36 and vane actuator 34. Under normal operation, the input shaft 36 turns port plate 32 which in turn rotates vane actuator 34 prior to input shaft 36 mechanically turning vane actuator 34. However, if supercharge pressure is lost, input shaft 36 can turn sufficiently to mechanically engage vane actuator 34 and subsequently control the pump yoke.

In summary, torsion bar 40 is included in the control design to provide feel to the control. A common complaint about servo control of hydraulic transmissions is the lack of feel provided to the operator regarding the amount of work being performed by the vehicle. With direct mechanical control, the yoke moments of the pumps can be sensed by the vehicle operator through the control linkage. The yoke moments of transmission pumps are centering moments which increase with outlet pressure and thus are directly proportional to the work being performed by the vehicle. The yoke moments also create the need for a servo control, since the loads created by the yoke moments in the control linkage lead to operator fatigue. Torsion bar 40 is included in this control design so that a small portion of the yoke moments can be transmitted back to the operator via the input shaft 36 and control linkage. The torsion bar thus provides the feel of manual control at the same time providing the reduced operating effort of a servo control. Correct feel can be obtained for different applications by sizing the diameter of torsion bar 40.

We claim:

1. A servo displacement control for mounting on a variable displacement hydraulic pump comprising, a housing,
an inlet for admitting fluid to said housing,
an outlet for discharging fluid from said housing,
a vane actuator movably mounted within said housing,
means connecting said vane actuator to a pump to vary the displacement thereof,
a port plate associated with said vane actuator,
control means for moving said port plate for controlling fluid flow to hydraulically move said vane actuator, and
manual control means for transmitting torque from said control means to said vane actuator.

2. A control set forth in claim 1 wherein said manual control means comprises an opening at one end of said vane actuator,
said control means being received in said opening and connected thereto by a loose fit.

3. A servo displacement control for mounting on a variable displacement hydraulic pump comprising,
a housing,
an inlet for admitting fluid to said housing,
an outlet for discharging fluid from said housing,
a vane actuator movably mounted within said housing,
means connecting said vane actuator to a pump to vary the displacement thereof,
a port plate associated with said vane actuator,
control means for moving said port plate for controlling fluid flow to hydraulically move said vane actuator, and
sensing means for providing said control with feel for the amount of work performed by said pump.

4. A control set forth in claim 3 wherein said sensing means comprises
a torsion bar connected between said control means and said means connecting said vane actuator to said pump.

5. A variable displacement hydraulic pump having a servo displacement control for varying the displacement of said pump, said control comprising,
a housing,
an inlet for admitting fluid to said housing,
an outlet for discharging fluid from said housing,
a vane actuator movably mounted within said housing,
means connecting said vane actuator to a pump to vary the displacement thereof,
a port plate associated with said vane actuator,
control means for moving said port plate for controlling fluid flow to hydraulically move said vane actuator, and
manual control means for transmitting torque from said control means to said vane actuator.

6. A control set forth in claim 5 wherein said manual control means comprises an opening at one end of said vane actuator,
said control means being received in said opening and connected thereto by a loose fit.

7. A variable displacement hydraulic pump having a servo displacement control for varying the displacement of said pump, said control comprising,
a housing,
an inlet for admitting fluid to said housing,
an outlet for discharging fluid from said housing,
a vane actuator movably mounted within said housing,
means connecting said vane actuator to a pump to vary the displacement thereof,
a port plate associated with said vane actuator,
control means for moving said port plate for controlling fluid flow to hydraulically move said vane actuator, and
sensing means for providing said control with feel for the amount of work performed by said pump.

8. A control set forth in claim 7 wherein said sensing means comprises
a torsion bar connected between said control means and said means connecting said vane actuator to said pump.

9. A variable displacement hydraulic pump having a servo displacement control for varying the displacement of said pump, said control comprising,
a housing,
an inlet for admitting fluid to said housing,
an outlet for discharging fluid from said housing,
a vane actuator movably mounted within said housing,
means connecting said vane actuator to a pump to vary the displacement thereof,
a port plate associated with said vane actuator,
control means for moving said port plate for controlling fluid flow to hydraulically move said vane actuator, and
passage means in said port plate and said vane actuator for admitting fluid to and from said housing, and wherein said inlet comprises,
a front cover for said housing,
a counterbore in said cover which receives said port plate,
an inlet passage in said front cover, and
an annular groove in said counterbore communicating with said inlet passage such that fluid can be supplied to said port plate through said inlet passage and said annular groove.

10. A control set forth in claim 9 wherein said port plate passage means comprises
diametrically opposed axial ports extending therethrough normally in communication with said inlet, and
opposing radial drain grooves.

11. A control set forth in claim 10 wherein said vane actuator passage means comprises
radial passages communicating with said axial passages,
opposing axial drain ports extending through said vane actuator, and
an annular groove communicating with said axial drain ports and said outlet,
said opposed axial passages and said radial passages normally being in communication with said inlet for providing fluid to said housing.

12. A control set forth in claim 11 wherein said vane actuator comprises
opposed vane portions having ends,
seal means at each end of said vane portions in sealing engagement with said housing, and
pressure chambers formed between said housing and said vane portions in communication with said radial passages in said vane actuator.

13. A control set forth in claim 12 wherein
said port plate is non-rotatably connected to said control means such that
fluid is normally supplied to said pressure chamber through said inlet, said opposed axial ports in said port plate, and said opposed axial passages and said radial passages in said vane actuator, so that when said control means is rotated, said port plate rotates said opposed axial ports out of communication with said inlet and communicates said pressure chambers with said outlet through said radial drain grooves in said port plate, said axial drain ports in said vane actuator and said annular groove.

14. A servo displacement control for mounting on a variable displacement hydraulic pump comprising, a housing, an inlet for admitting fluid to said housing, a vane actuator movably mounted within said housing, means connecting said vane actuator to a pump to vary the displacement thereof, a port plate associated with said vane actuator, control means for moving said port plate for controlling fluid flow to hydraulically move said vane actuator, passage means in said port plate and said vane actuator for admitting fluid to and from said housing, and wherein said inlet comprises, a front cover for said housing, a counterbore in said cover which received said port plate, an inlet passage in said front cover, and an annular groove in said counterbore communicating with said inlet passage such that fluid can be supplied to said port plate through said inlet passage and said annular groove.

15. A control set forth in claim 14 wherein said port plate passage means comprises diametrically opposed axial ports extending therethrough normally in communication with said inlet, and opposing radial drain grooves.

16. A control set forth in claim 15 wherein said vane actuator passage means comprises diametrically opposed axial passages, radial passages communicating with said axial passages, opposing axial drain ports extending through said vane actuator, and an annular groove communicating with said axial drain ports and said outlet, said opposed axial passages and said radial passages normally being in communication with said inlet for providing fluid to said housing.

17. A control set forth in claim 16 wherein said vane actuator comprises opposed vane portions having ends, seal means at each end of said vane portions in sealing engagement with said housing, and pressure chambers formed between said housing and said vane portions in communication with said radial passages in said vane actuator.

18. A control set forth in claim 17 wherein said port plate is non-rotatably connected to said control means such that fluid is normally supplied to said pressure chamber through said inlet, said opposed axial ports in said port plate, and said opposed axial passages and said radial passages in said vane actuator, so that when said control means is rotated, said port plate rotates said opposed axial ports out of communication with said inlet and communicates said pressure chambers with said outlet through said radial drain grooves in said plate, said axial drain ports in said vane actuator and said annular groove.

19. A variable displacement hydraulic pump having a servo displacement control for varying the displacement of said pump, said control comprising, a housing, an inlet for admitting fluid to said housing, an outlet for discharging fluid from said housing, a vane actuator movably mounted within said housing, means connecting said vane actuator to a pump to vary the displacement thereof, a port plate within said housing and constrained against said vane actuator and rotatable relative to said vane actuator for controlling fluid to and from said housing, and control means for moving said port plate for controlling fluid flow to hydraulically move said vane actuator.

20. A control set forth in claim 19 wherein said hydraulic pump is a piston pump.

21. A control set forth in claim 19 wherein said control is a self-contained unit adapted to be mounted to a variable displacement hydraulic pump.

22. A control set forth in claim 1 further comprising sensing means for providing said control with feel for the amount of work performed by said pump.

23. A control set forth in claim 22 wherein said sensing means comprises a torsion bar connected between said control means and said means connecting said vane actuator to said pump.

24. A control set forth in claim 19 further comprising manual control means for transmitting torque from said control means to said vane actuator.

25. A control set forth in claim 24 wherein said manual control means comprises an opening at one end of said vane actuator, said control means being received in said opening and connected thereto by a loose fit.

26. A control set forth in claim 19 further comprising passage means in said port plate and said vane actuator for admitting fluid to and from said housing.

27. A control set forth in claim 26 wherein said inlet comprises a front cover for said housing, a counterbore in said cover which receives said port plate, an inlet passage in said front cover, an annular groove in said counterbore communicating with said inlet passage, such that fluid can be supplied to said port plate through said inlet passage and said annular groove.

28. A control set forth in claim 27 wherein said port plate passage means comprises diametrically opposed axial ports extending therethrough normally in communication with said inlet, and opposing radial drain grooves.

29. A control set forth in claim 28 wherein said vane actuator passage means comprises diametrically opposed axial passages, radial passages communicating with said axial passages, opposing axial drain ports extending through said vane actuator, and an annular groove communicating with said axial drain ports and said outlet, said opposed axial passages and said radial passages normally being in communication with said inlet for providing fluid to said housing.

30. A control set forth in claim 29 wherein said vane actuator comprises opposed vane portions having ends, seal means at each end of said vane portions in sealing engagement with said housing, and pressure chambers formed between said housing and said vane portions in communication with said radial passages in said vane actuator.

31. A control set forth in claim 30 wherein said port plate is non-rotatably connected to said control means such that fluid is normally supplied to said pressure chamber through said inlet, said opposed axial ports in said port plate, and said opposed axial passages and said radial passages in said vane actuator, so that when said control means is rotated, said port plate rotates said opposed axial ports out of communication with said inlet and communicates said pressure chambers with said outlet through said radial drain grooves in said port plate, said axial drain ports in said vane actuator and said annular groove.

32. A servo displacement control for mounting on a variable displacement hydraulic pump comprising, a housing, an inlet for admitting fluid to said housing, an outlet for discharging fluid from said housing, a vane actuator movably mounted within said housing, means connecting said vane actuator to a pump to vary the displacement thereof, a port plate within said housing and constrained against said vane actuator and rotatable relative to said vane actuator for controlling fluid to and from said housing, and control means for moving said port plate for controlling fluid flow to hydraulically move said vane actuator.

33. A control set forth in claim 32 wherein said hydraulic pump is a piston pump.

34. A control set forth in claim 32 further comprising sensing means for providing said control with feel for the amount of work performed by said pump.

35. A control set forth in claim 34 wherein said sensing means comprises a torsion bar connected between said control means and said means connecting said vane actuator to said pump.

36. A control set forth in claim 32 further comprising manual control means for transmitting torque from said control means to said vane actuator.

37. A control set forth in claim 36 wherein said manual control means comprises an opening at one end of said vane actuator, said control means being received in said opening and connected thereto by a loose fit.

38. A control set forth in claim 32 further comprising passage means in said port plate and said vane actuator for admitting fluid to and from said housing.

39. A control set forth in claim 38 wherein said inlet comprises a front cover for said housing, a counterbore in said cover which receives said port plate, an inlet passage in said front cover, an annular groove in said counterbore communicating with said inlet passage, such that fluid can be supplied to said port plate through said inlet passage and said annular groove.

40. A control set forth in claim 39 wherein said port plate passage means comprises diametrically opposed axial ports extending therethrough normally in communication with said inlet, and opposing radial drain grooves.

41. A control set forth in claim 40 wherein said vane actuator passage means comprises diametrically opposed axial passages, radial passages communicating with said axial passages, opposing axial drain ports extending through said vane actuator, and an annular groove communicating with said axial drain ports and said outlet, said opposed axial passages and said radial passages normally being in communication with said inlet for providing fluid to said housing.

42. A control set forth in claim 41 wherein said vane actuator comprises opposed vane portions having ends, seal means at each end of said vane portions in sealing engagement with said housing, and pressure chambers formed between said housing and said vane portions in communication with said radial passages in said vane actuator.

43. A control set forth in claim 42 wherein said port plate is non-rotatably connected to said control means such that fluid is normally supplied to said pressure chamber through said inlet, said opposed axial ports in said port plate, and said opposed axial passages and said radial passages in said vane actuator, so that when said control means is rotated, said port plate rotates said opposed axial ports out of communication with said inlet and communicates said pressure chambers with said outlet through said radial drain grooves in said plate, said axial drain ports in said vane actuator and said annular groove.

* * * * *